United States Patent [19]

Keprda

[11] Patent Number: 4,641,004

[45] Date of Patent: Feb. 3, 1987

[54] KEY MODULE FOR KEYBOARDS HAVING A DOME-SHAPED KEY MEMBER OF RESILIENT MATERIAL

[75] Inventor: Jaroslav Keprda, Munich, Fed. Rep. of Germany

[73] Assignee: Siemens Aktiengesellschaft, Berlin and Munich, Fed. Rep. of Germany

[21] Appl. No.: 669,794

[22] Filed: Nov. 9, 1984

[30] Foreign Application Priority Data

Dec. 2, 1983 [DE] Fed. Rep. of Germany ... 8334679[U]

[51] Int. Cl.[4] ..... H01H 3/12

[52] U.S. Cl. ..... 200/340; 200/159 B; 200/302.2

[58] Field of Search ..... 200/159 B, 302.2, 340

[56] References Cited

U.S. PATENT DOCUMENTS

| | | | |
|---|---|---|---|
| 3,900,712 | 8/1975 | Fukao | 200/307 |
| 3,917,917 | 11/1975 | Murata | 200/159 B |
| 4,021,630 | 5/1977 | Taylor | 200/159 B |
| 4,352,968 | 10/1982 | Pounds | 200/302.2 |
| 4,441,001 | 4/1984 | Miyano et al. | 200/159 B |
| 4,527,030 | 7/1985 | Oelsch | 200/159 B |

FOREIGN PATENT DOCUMENTS

| | | | |
|---|---|---|---|
| 0064041 | 11/1982 | European Pat. Off. . | |
| 3041470 | 6/1982 | Fed. Rep. of Germany . | |
| 2086804 | 5/1982 | United Kingdom . | |
| 2113920 | 8/1983 | United Kingdom | 200/159 B |
| 2140623 | 11/1984 | United Kingdom | 200/302.2 |

*Primary Examiner*—Stephen Marcus
*Assistant Examiner*—Renee S. Luebke
*Attorney, Agent, or Firm*—Hill, Van Santen, Steadman & Simpson

[57] ABSTRACT

A bell or dome-shaped key member of elastic material is fitted at its edge which bounds the open side of the key member into a groove of a key housing part which can be latched to a printed circuitboard, the fit is provided with a web-like projection 7 such that the key member 5, together with the housing part 1, forms a composite member which can be manipulated in an uncomplicated manner.

8 Claims, 1 Drawing Figure

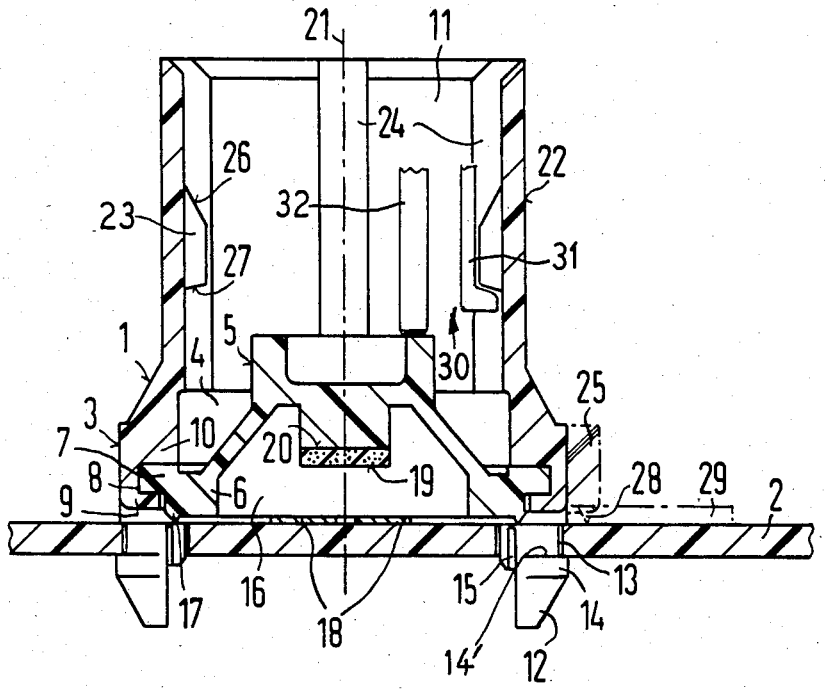
21
11
24
26
22
23
32
31
27
1
5
4
30
25
3
10
7
20
8
19
28
29
2
9
6
16
18
15
13
17
14
14'
12

KEY MODULE FOR KEYBOARDS HAVING A DOME-SHAPED KEY MEMBER OF RESILIENT MATERIAL

BACKGROUND OF THE INVENTION

1. Field of the Invention

The present invention relates to a key comprising a bell or dome-shaped key member of elastic material, an edge limiting the open side of the key member being pinched between a base plate and a key housing.

2. Description of the Prior Art

A key of the type set forth above is generally known from the German published application No. 30 41 470, incorporated herein by this reference. The key member referred to in that publication as a sealing membrane has its flat outer edge seated on the surface of a supporting part referred therein as a base plate and is pressed against the base plate by a housing part referred to therein as a screwed cover. As a consequence, the space in which the contacts of the key are located and which is surrounded by the key member and the base plate is sealed from the environment, particularly on the operating side of the key, so that no foreign body can enter into the contact space formed by the key member and the base plate, at least not from the operating side.

The key known from the aforementioned German published application No. 30 41 470 is also useable as a key module so that a keyboard can be formed of a plurality of such keys which are secured to a plate.

Given this known key, however, a disc separate from the plate carries the fixed contacts of the key.

In order to simplify such keys, there is a desire to dispose the fixed contacts directly on a plate to which the key is secured. In such a case, in particular, the number of parts of which the key is composed can be further reduced. The outer edge of the key member can then be pinched between a housing part of the key and the plate.

It is desirable, particularly when equipping such plates with keys, if as few key parts, to be manipulated separately from one another, exist.

SUMMARY OF THE INVENTION

It is therefore the object of the present invention to provide a key of the type generally set forth above in which only a single key part must be manipulated when such keys are secured to a plate carrying the fixed contacts of the keys.

The above object is achieved, according to the present invention, in that the key housing part has nische-like recesses in the region of the edge of the key member and at its side facing the key member, the recesses constituting access openings provided essentially at right angles relative to the base plate, and in that the key member comprises projections in the regions of its edge pressed into the recesses.

In the above manner, the key member and the key housing part can be connected to one another before these parts are fixed at a plate carrying fixed contacts of the key without special connecting means such as, for example, glue being required for this purpose. One therefore obtains a composite member comprising the key housing part and key member which can be manipulated in an uncomplicated manner and therefore considerably facilitates the assembly operation.

It can be provided in accordance with a further feature of the invention that the nische-like recesses comprise a continuous circumnavigant groove of the key housing part and that the edge of the key member comprises a web-like projection corresponding to the groove.

A particularly reliable seating of the key member in the key housing part derives in this manner.

It can then also be provided within the scope of the invention that the key housing part is provided with locking pins at its side directed parallel to the open side of the key member.

As known per se, the composite member comprising in such a fashion of a key housing part and a key member can be secured to the plate carrying the fixed contacts of the key in a particularly uncomplicated fashion.

Finally, it can also be provided that the edge of the key member comprises a wedge-shaped, circumnavigant web projecting from the edge parallel to the direction of the axis of the key; that the key housing part is provided with a circumnavigant edge projection at its outside in the region of the edge, the edge projection having a wedge-shaped, circumnavigant web projecting parallel to the direction of the axis; and that the key housing part comprises a hollow cylindrical projection at its side facing away from the open side of the key members; that the inside of the projection is provided with grooves directed parallel to the axis; and that ramp members are disposed in the grooves, the ramp members are disposed in the grooves, the ramp members having respective, steeper glide faces at their sides facing the key member than at their sides facing away from the key member.

BRIEF DESCRIPTION OF THE DRAWING

Other objects, features and advantages of the invention, its organization, construction and operation will be best understood from the following detailed description taken in conjunction with the accompanying drawing on which there is a sectional elevation of a key constructed in accordance with the present invention.

DESCRIPTION OF THE PREFERRED EMBODIMENTS

Referring to the drawing, a composite member comprising a key housing part and a key member is illustrated latched to a plate carrying the fixed contacts of the key.

It may be specifically derived from the drawing that the key housing part 1 comprises a dimensionally stable synthetic material which surrounds a space for in which the key member 5 of elastic plastic material or rubber is disposed, the housing part 1 surrounding the space 4 with lateral walls 3 extending at right angles relative to a base plate 2.

The key member 5, designed approximately dome or bell-shaped, comprises a thickened edge 6 facing the plate 2 and the edge 6 is provided with a web-like projection 7 directed parallel to the plate 2 and toward the key housing part 1. The projection 7 is fitted into a circumnavigant groove 8 of the key housing part 1 which is bounded by two webs 9, 10. The webs 9, 10 are directed toward the center of the key member 5 and therefore embrace the projection 7 together with the lateral walls 3 of the key housing part 1 such that the key member 5 fitted into the groove 8 with the web-like projection 7 is connected to the key housing part 1 in this manner.

The web 10 of the key housing part 1 at a greater distance from the base plate 2, thereby simultaneously serves as an abutment in order to press the edge 6 of the key member over the key housing part 1 in the direction towards the base plate 2 and against the base plate 2 when the composite member 11, comprising the key housing part 1 and the key member 5, is placed on the base plate 2.

When the composite member 11 is put in place on the base plate 2, setpins 12, designed radially-resistant, penetrate respective bores 13 provided in the base plate 2 and matched to the set pins 12. In the radially-resistant region of the setpins 12, the same are provided with a collar 14 which increases their diameters and form rearwardly facing locking surfaces 14'. The collar 14 can proceed through the bore 13 in the base plate 2 as a result of radial compression of the set pins 12 and then re-assume its original circumference through radial expansion to lock the composite member 11 to the base plate 2. The radial compressability of the set pins 12 can, for example, be affected by slotting the pins as shown at 15.

After the composite member 11 has been latched over the base plate 2, a contact space 16 is sealed from the environment, particularly relative to the operating side of the key, since the bell-shaped or dome-shaped key member 5 has an edge 6 pressed against the base plate 2. The sealing effect can be further improved by the provision of a wedge-shaped resilient web 17 of the key member 5 which projects from the edge 6 to engage the upper surface of the base plate 2.

The fixed contacts 18, fixed in the manner of a printed circuit to the base plate 2 below the key member 5, which are insulated from one another in the unactuated condition of the key are connected to one another by way of an electrically-conductive coating 19 which is disposed on a projection 20 of the key member 5 when the dome-shaped or bell-shaped key member 5 is caused to collapse in response to the application of a downward force on the key member 5 in the direction of the axis 21 of the key so that the conductive coating 19 comes to engage and lie against the contacts 18 on the base plate 2. When the force on the key is released, the key member 5 automatically springs back into its initial shape.

The sealing of the contact space 16 from the environment of the key can be even further improved when the key housing 1 is provided with an outer, circumnavigant edge projection 25 in the region of the edge 6, the edge projection 25 comprising a circumnavigant, wedge-shaped resilient web 28 directed toward and yieldably engageable with the base plate 2. When the composite member 11 is put in place on the plate 2, the web 28 presses into an elastic mat 29 (the projection 25, the web 28 and the mat 29 being shown in phantom), the mat comprising recesses for the region of the base plate 2 which, for example, respectively bounded by the webs 9. Such a mat 29 is provided, for example, for shielding electrostatic noise fields from the keyboard.

At its side facing away from the open side of the key member 5, the housing part 1 is provided with a hollow, cylindrical projection 22 extending in the direction of the axis 21, the projection 22 comprising grooves 24 on its inside which are directed parallel to the axis 21. Ramp members 23 which have flatter gliding faces at the upper side 26 which faces away from the key member 5 than at its lower side 27 are disposed in these grooves.

A key cover 30 provided with resilient snap-in arms 31 can thereby be connected to the housing part 1 in an uncomplicated manner, whereby the snap-in arms thereof slide in the grooves 24. When the key cover is put in place on the projection 22, the snap-in arms resiliently flex toward the axis 21 and can easily glide over the ramp members 23 from the sides 26, but are then locked by the sides 27 with the projection provided at the ends of the snap-in arms which are directed against the grooves 24. When the key cover is further pressed in, the same contacts the key member 5 at its upper end with central projections 32 and causes it to cave in or, respectively, collapse. When the key cover is released, then it is returned to its initial position due to the resiliency of the key member 5.

It can be achieved by way of an appropriate dimensioning of the retaining forces between the cover and the housing part 1, as well as between the housing part 1 or, respectively, the composite member 11, and the plate 2 that the cover can be more easily removed from the housing part 1 or, respectively, from the composite member than the composite member 11 can be remcved from the plate 2.

The present composite member 11 creates a key module with whose assistance keyboards can be constructed in an uncomplicated manner, keyboards can be modified in structure and, finally, key modules can be easily replaced.

Although I have described my invention by reference to a particular illustrative embodiment thereof, many changes and modifications may become apparent to those skilled in the art without departing from the spirit and scope of the invention. I therefore intend to include within the patent warranted hereon all such changes and modifications as may reasonably and properly be included within the scope of my contribution to the art.

I claim:

1. A key module for mounting on a base plate which carries at least one fixed contact, said key module comprising:

a bell-shaped resilient key member including chamber means defining a contact chamber for the at least one fixed contact carried on the base plate, at least one movable contact mounted on said bell-shaped key member to contact the at least one fixed contact in response to the application of an operating force to said bell-shaped key member, an edge portion defining an open end of said bell-shaped key member, and projection means projecting laterally from and about said edge portion;

a one-piece key housing part surrounding said bell-shaped key member and including recess means constituting at least one access opening at essentially right angles relative to the base plate for tightly receiving said projection means to form a composite member with said bell-shaped key member with said projection means pressed and extending through said openings into said recess means; and mounting means extending from said composite member for mounting the same to the base plate with said edge portion pinched therebetween.

2. The key module of claim 1, wherein the base plate constitutes a circuitboard which has upper and lower surfaces and carries a pair of contacts, on the upper surface, including the at least one contact, and wherein:

said bell-shaped key member of resilient material includes an upper part for receiving an operating force to collapse said bell-shaped member, a lower part for engaging the cirucitboard, said lower part including said projection means extending parallel and spaced from the circuitboard when mounted thereon, and said movable contact means for bridging the pair of circuitboard contacts when the key is operated, said bell-shaped member restoring to break the contacts upon removal of the operating force.

3. The key module of claim 2, wherein:

said projection means comprises a circumnavigant projection; and said recess means comprises a complementary circumnavigant groove.

4. The key module of claim 2, wherein the circuitboard has spaced holes therethrough and wherein:

said mounting means comprises a plurality of resilient pins extending from said key housing part for receipt in the circuitboard holes, each of said pins comprising a ramp surface for engaging the edge of a hole to cause the pin to yield during insertion and a latch surface for engaging the lower surface of the circuitboard upon complete insertion.

5. The key module of claim 2, wherein:

said lower part comprises a wedge-shaped circumnavigant resilient sealing web for engaging the upper surface of the circuitboard.

6. The key module of claim 2, wherein:

said key housing part comprises a circumnavigant edge portion extending transversely thereof and a circumnavigant resilient sealing web extending from said circumnavigant edge portion of said housing part for engaging the upper surface of the circuitboard at a location spaced from said lower part of said key member.

7. The key module of claim 2, wherein:

said key housing part comprises a hollow cylindrical projection including an inner surface, a plurality of grooves spaced about said inner surface, and a respective ramp structure comprising an upwardly facing first ramp at a first angle with respect to said hollow cylindrical projection and a downwardly facing second ramp at a greater second angle and constituting a cover latching means.

8. The key module of claim 7, and further comprising:

a cover including at least one central projection for engaging said upper part and transmitting the operating force thereto, and a plurality of resilient arms slidably received in respective grooves, each of said arms engaging and flexed inwardly by the respective first ramp and each including a latching surface complementary to and engaging the respective second ramp.

* * * * *